United States Patent [19]

Caine

[11] Patent Number: 5,033,629

[45] Date of Patent: Jul. 23, 1991

[54] STAND FOR FELT TIP PENS

[76] Inventor: Robert Caine, One Crabtree Ln., Roslyn, N.Y. 11576

[21] Appl. No.: 510,615

[22] Filed: Apr. 18, 1990

[51] Int. Cl.[5] ..... A47F 7/00

[52] U.S. Cl. ..... 211/69.5

[58] Field of Search ..... 211/69.1, 69.5, 69.2; 401/194, 258

[56] References Cited

U.S. PATENT DOCUMENTS

| | | | |
|---|---|---|---|
| 2,650,570 | 9/1953 | Voelcker | 211/69.5 |
| 3,176,662 | 4/1965 | Williams | 211/69.5 |
| 3,245,164 | 4/1966 | Arenson | 211/69.5 X |
| 4,334,622 | 6/1982 | Mutschler | 211/69.5 |
| 4,355,726 | 10/1982 | Mutschler | 211/69.5 |
| 4,548,325 | 10/1985 | Hojer et al. | 211/69.5 |
| 4,798,310 | 1/1989 | Kasai et al. | 211/69.5 X |

FOREIGN PATENT DOCUMENTS

| | | | |
|---|---|---|---|
| 2323779 | 11/1974 | Fed. Rep. of Germany | 211/69.5 |

*Primary Examiner*—Robert W. Gibson, Jr.

*Attorney, Agent, or Firm*—Bauer & Schaffer

[57] ABSTRACT

A desk type stand for a felt tip pen that is employed without a cover. The pen stand has a hollow container having an opening at its upper surface for receiving an appropriate felt tip pen. A pen support is disposed in the opening in the container. The support is made of elastomeric or rubber material which is inflexible and firm about its outer periphery and flexible and thin at an opening at its center, allowing the felt tip of the pen to move through the doughnut-shaped insert into the container after which the flexible portion of the insert or washer seals the felt tip in the container out of contact with the ambient air.

9 Claims, 2 Drawing Sheets

STAND FOR FELT TIP PENS

BACKGROUND OF THE INVENTION

This invention relates to a stand for a felt tip pen, and more particularly, this invention relates to a desk type pen stand for a felt tip pen.

Felt tip pens are easy to use and are decorative; however, they give rise to a most irksome problem. Since such pens cannot be left uncapped for extended periods of time as the felt tip would dry out, they are not convenient as desk pens wherein intermittent use is natural.

A wide variety of desk stands for pens are known. Some are even known to be specifically formed for felt pens. For example, U.S. Pat. No. 3,020,578 discloses an ink well for a felt pen comprising an elongated cylindrical neck into which the pen is inserted and held in a slanted position by a cap which would otherwise close the neck. The neck is mounted on the container, and both contain a pad saturated with ink to maintain the tip wet. U.S. Pat. No. 4,548,325 discloses a stand for a drafting pen in which the tip of the pen is pressed against a plastic tube, and the handle is held in an annular elastic element which acts to hold the tip in soft but non-sealing contact with the tube.

U.S. Pat. No. 4,493,575 discloses a cap for a pen which is provided with a seal means, while U.S. Pat. Nos. 1,704,248; 3,176,662; and 1,620,529 disclose wells having elongated, tubular necks without seals.

All of the foregoing patents solve the irksome problem by maintaining the tip in contact with a reservoir of ink.

The above-mentioned patents, while accomplishing their purposes, are disadvantageous in that they do not provide a pen stand for a felt tip pen having a dry well and seal means which keeps the ink wet without contact with a reservoir or pad. There exists the need for such a structure. The present invention fulfills such a need.

The present invention may also be adapted for use with fluid ink reservoirs wherein the pen can be held in the reservoir in contact with the fluid yet sealed about its periphery guarding against loss through evaporation of the fluid.

BRIEF STATEMENT OF THE INVENTION

In accordance with the invention there is provided a desk stand for a felt tip pen that is employed without a covering cap comprising a base having an interior chamber for receiving the pen. The top of the base has an opening in its surface in which a pen support is made of elastomeric material or rubber which is inflexible and firm about its outer periphery and which is formed with a flexible membrane body at its center. The flexible and thin membrane has a mouth, allowing the felt tip or tip of the pen to pass easily through the mouth into the chamber, yet enclosing and sealing the pen from contact with ambient air.

In one embodiment the pen support has a central sleeve into which the pen tip passes and which collapses and seals the tip.

In another embodiment the pen support is in the form of a disk which is held by its periphery between two sections of the base or in a groove on the interior of the base or by streching the disk over the top of the base.

In yet another embodiment the body is provided with an interior neck which is threaded and to which can be screwed an open ink or fluid bottle or the like in alignment with the mouth and into which the pen can fit.

THE DRAWINGS

In order to describe the pen stand of the invention more fully, reference is directed to the accompanying drawings thereof which are to be taken in conjunction with the following description and in which drawings.

DESCRIPTION OF THE PREFERRED EMBODIMENTS

Figure 1:
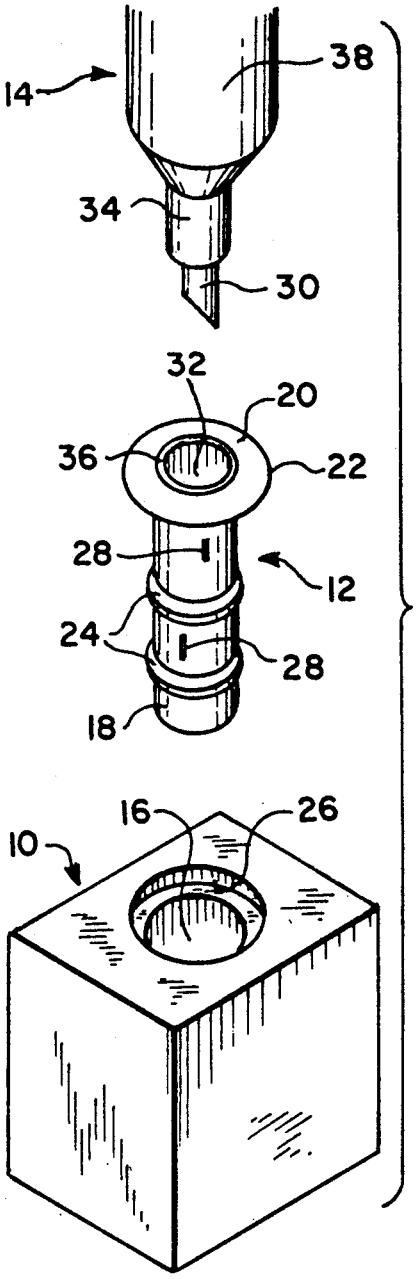
FIG. 1 is an exploded perspective view of a desk stand according to the invention, showing the pen support and pen.

Referring now to FIG. 1, a desk type stand for a felt tip pen in accordance with the invention comprises a base container 10 having bottom, top, and side walls. Located within the container 10 is a removable pen support 12 by which the felt tip pen 14 is held. The shape of the container is not critical and is selected with design and ornamental appearance in mind. For the sake of simplicity, a rectangular form is illustrated, although it may be cylindrical if desired. For the same reasons, the container may be made of plastic materials such as polyurethane or polyethylene, although wood, metal, ceramic or stone can be used. The bottom wall can be provided with a cushion such as an adhesive pad or the like to hold it to a desk or table top.

The top wall of the base is provided with an opening or cut-out 16, preferably circular in shape, into which the pen support 12 is fixedly inserted. The pen support 12 comprises a central sleeve 18 of soft, pliable material, having at its upper end, a radially extending flange 20 which becomes progressively more rigid and hard toward the outer periphery 22. The cylindrical sleeve 18 is formed with a plurality of ribs 24 extending radially about the entire periphery of the sleeve. The support 12 is placed within the hole 16 in the base so that the ribs 24 coact with the inner wall of hole 16 securing the sleeve firmly in place and the flange 20 seats in an annular recess 26 formed about the hole 16 whereby the top 20 of the sleeve is flush with the top of the base and is fixedly held in place with the sleeve 18 depending from the top into the container spaced from the inner wall of the hole by the ribs 24. Since the sleeve 18 is somewhat flexible and relatively thin along its length, its spacing will permit facile passage into it of the felt tip 30 of the pen 14. As the pen moves through the mouth 32 of the sleeve the flexible and thin sleeve portion seals about the finger grip 34 of the pen, leaving the felt tip free in the container and out of contact with ambient air. One or two elongated slits 28 may be made in the sleeve to permit such movement and increase flexibility.

In order to further insure sealing of the pen tip 30 in the sleeve 18, the mouth 32 may be provided with a torroidal lip 36 which engages the barrel 38 of the pen.

Figure 2:
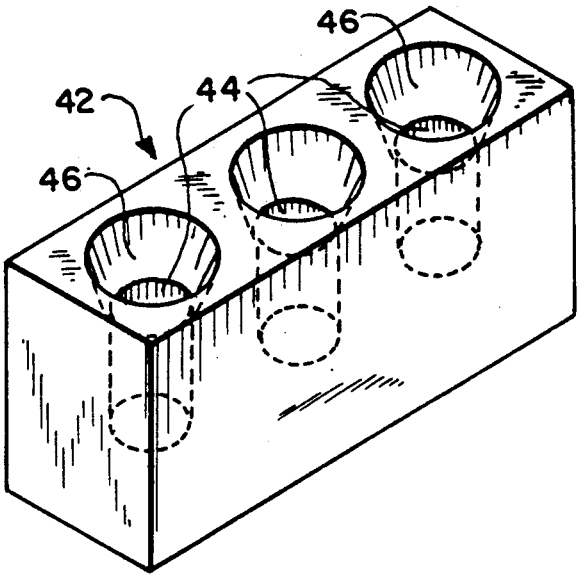
FIG. 2 is a perspective view of a modified desk stand for a plurality of pens.
Figure 3:
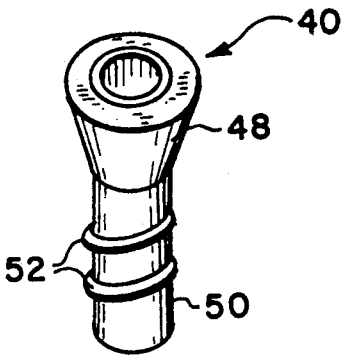
FIG. 3 is a perspective view of the pen support removed from the stand shown in FIG. 2.

Another embodiment of the present invention is shown in FIG. 2. In this embodiment a plurality of pen supports 40 are inserted in a single base 42 (here shown rectangular to simulate a "desk set"), each pen support being set within an individual hole 44 in the top surface of the base. Each hole is countersunk at 46 to provide a conical recess on which the pen support will sit. Each pen support 40 is provided with a conforming funnel section 48 terminating in a cylindrical depending sleeve 50. The outer surface of the funnel section and cylinder is provided with a rib structure, here shown as being a continuous helical rib 52. The helical rib may be helpful in "screwing" the stand into place; however, other rib structures, i.e. vertical, horizontal, etc., may also be used for the purpose of stabilizing the pen support.

Figure 4:
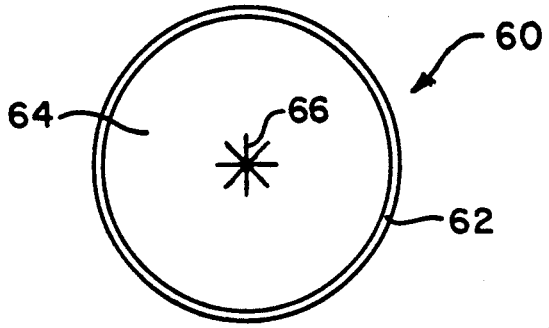
FIG. 4 is a perspective view of another embodiment of the pen support.

In FIG. 4 the pen support 60 comprises a diaphragm having a substantially rigid but bendable peripheral ring 62 and a thin sheet-like central body 64 of rubber or plastic material, preferably formed to be thin at its center 66 and progressively thicker as its extends radially outward. The center 66 of the body 64 is slit in star shape so as to provide an opening for the insertion of the felt-tipped pen. The slits permit the pen to be introduced yet reengages and conforms to the surface of the pen to seal the pen.

The diaphragm pen support 60 may be mounted in many ways on suitable containers or the like. For example, in FIG. 5 a container 61 formed of a separable bottom 70 and top 72. Each of the bottom and top members is provided with a recess 74 for receiving the diaphragm pen support 60 and a central hole 76, allowing the pen to pass from the top into the bottom. By closing the container top 72 on to the container bottom 70, the diaphragm pen support 60 is seated in the recess 74 and clamped tightly in place, allowing the pen to be inserted and removed from the hole 76 without difficulty. Suitable connecting latches or fasteners 80 provide means for joining the top and bottom container parts securely together. Other closures may he used.

Figure 6:
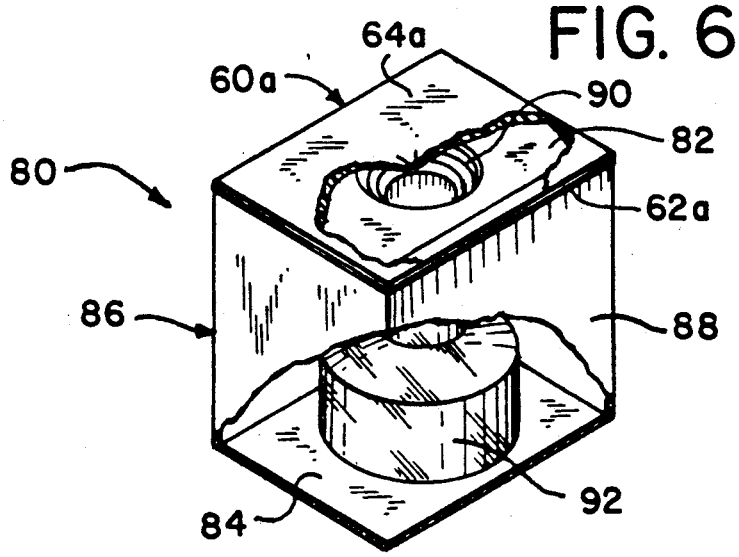
FIG. 6 is perspective view of yet another embodiment of the pen support and a container.

In FIG. 6 a similarly formed diaphragm pen support **60*a* is mounted on a container 80 so that the central body 64*a* stretches flat across the top 82 of the container 80 and the ring 62*a* bends over the edge. If necessary, a band or other fastener can be used to hold the diaphragm pen support 60*a*. The container 80 is formed of a flat base 84 and a hollow parallelepiped cover 86 having a depending peripheral skirt 88 which engages with the base 84. An opening 90 in the top of the container 80 is helically threaded in a manner so as to conform to the top of a conventional fluid bottle 92 such as an ink bottle. In this manner, replenishment of the ink or fluid can be made each time the pen is inserted through the center 66 of the diaphragm 60*a***.

Figure 5:
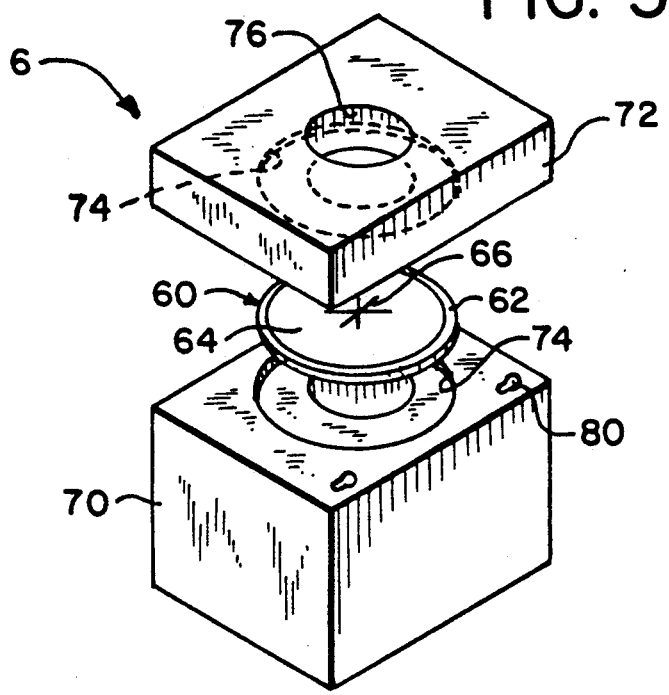
FIG. 5 is a perspective view of the pen support and another stand.

FIGS. 5 and 6 illustrate features which may be singly incorporated in the other embodiments shown in FIGS. 1–4. For example, the formation of a multipart housing can be adapted to the multichamber construction of FIG. 2. The concept of providing a threaded screw top and bottle as shown in FIG. 6 may be adapted to provide the pen support 12 and its container 10, shown in FIG. 1 with a similar threaded connection. Likewise, the diaphragm of FIG. 5 may be used in the embodiment of FIGS. 1 and 2.

The pen stand of this invention presents many advantages. In addition to being of simple design, the elements of the stand are made of relatively inexpensive and readily available materials which are simple to assemble.

The pen stand of the present invention can be used with a wide variety of inexpensive and available felt tip pens which can be obtained through commercial channels and whose caps may be discarded when the pens are inserted in the pen stand without the tips drying out. If desirable, felt tip pens specifically designed as desk type pens can be made and used with the inventive pen stand. Since the pens disposed in the pen stand can be used without the need to remove the cap each time, they may be made initially without a cap. The pen support, having variable flexibility resulting from the progression of thickness, allows the pen to be repeatedly inserted and removed from the pen stand with the use of one hand, thus freeing the other hand for other use. In contrast, with the normal felt tip pen one must remove the cap each time it is used and then replace the cap on the pen after use to prevent the felt tip from drying out, thus requiring two hands, and it is difficult to accomplish, for example, if one is on the telephone and desires to write at the same time with the usual felt tip pen. One must hold the telephone receiver in one hand and must attempt to remove the cap from the usual felt tip pen with the other hand before being able to write with it, which is a difficult maneuver when one does not put down the telephone receiver. Numerous other advantages of the pen stand of this invention will be apparent to those skilled in the art.

Moreover, numerous modifications of the pen stand of this invention may be made without deporting from the spirit and scope of the invention. It is to be understood, therefore, that the invention is not to be limited to the embodiments described above, except as defined in the appended claims.

What is claimed is:

1. A stand for a felt tip pen that is employed without a covering cap, comprising a container having a top, bottom, and at least one side wall, defining a hollow interior chamber, said top having at least one opening provided with a pen support, said pen support comprising a hollow, tubular shaft having a radially extending flange at its upper end, said flange being inflexible and firm about its outer periphery, and said tubular shaft being flexible and thin, allowing the felt tip of said pen to pass easily into said interior chamber and simultaneously engage the surface of said pen to enclose and seal that portion of the pen in said chamber from contact with ambient air.

2. A stand wherein the top of said container is provided with a recess conforming to said flange for retaining said flange therein and said tubular shaft within said chamber.

3. The stand according to claim 2 wherein the interior chamber is cylindrical and has a diameter substantially equal to that of said tubular shaft of said pen support, said shaft being provided with at least one annular ridge adapted to engage and fix with said chamber.

4. The stand according to claim 3 wherein the opening in said top is countersunk to permit recessing of the radially extending flange below the surface of said top.

5. The stand according to claim 2 wherein the top of the container is separable from the side wall, and the pen support is arranged to have its peripheral flange secured therebetween.

6. The stand according to claim 2 wherein the top of said container is separable relative to the remaining walls thereof, and the opening in said top is provided with a helical screw thread, a fluid container located in said container having a neck provided with a helical thread adapted to be removably attached to said opening, said pen being insertable in said fluid container.

7. The stand according to claim 3 wherein said tubular shaft is provided with at least one slit to increase flexibility thereof.

8. A stand for a felt tip pen that is employed without a covering cap comprising a container having a top, bottom, and at least one side wall defining a hollow interior chamber, said top having at least one opening provided with a pen support, said pen support comprising a diaphragm having a relatively bendable peripheral ring and a central membraneous body having an opening for the insertion of the tip of said pen into the interior chamber to enclose and seal that portion of the pen in said chamber from contact with ambient air.

9. The stand according to claim 8 wherein said opening in said diaphragm is formed by a plurality of cross slits.

* * * * *

UNITED STATES PATENT AND TRADEMARK OFFICE

CERTIFICATE OF CORRECTION

PATENT NO. : 5,033,629

DATED : July 23, 1991

INVENTOR(S) : ROBERT CAINE

It is certified that error appears in the above-identified patent and that said Letters Patent is hereby corrected as shown below:

Column 4;

Claim 2, line 1 replace "A stand" with --The stand according to Claim 1-- line 3 delete "therein"

Signed and Sealed this

Twelfth Day of January, 1993

*Attest:*

DOUGLAS B. COMER

*Attesting Officer*

*Acting Commissioner of Patents and Trademarks*